US005205943A

United States Patent [19]

Jazzar

[11] Patent Number: 5,205,943

[45] Date of Patent: Apr. 27, 1993

[54] APPARATUS FOR MANUFACTURE OF PRECAST CONCRETE BUILDING UNITS

[76] Inventor: M. Omar A. Jazzar, P.O. Box 777, Clearwater, Fla. 34617

[21] Appl. No.: 712,179

[22] Filed: Jun. 7, 1991

Related U.S. Application Data

[60] Continuation-in-part of Ser. No. 558,858, Jul. 27, 1990, Pat. No. 5,081,805, which is a division of Ser. No. 398,095, Aug. 23, 1989, abandoned.

[51] Int. Cl.[5] ..... B28B 7/22

[52] U.S. Cl. ..... 249/27; 249/99; 249/101; 249/144; 249/152; 249/155

[58] Field of Search ..... 249/11, 26, 27, 34, 249/99, 101, 102, 144, 152, 153, 155, 160, 163

[56] References Cited

U.S. PATENT DOCUMENTS

| | | | |
|---|---|---|---|
| 2,582,161 | 1/1952 | Randall | 425/424 |
| 2,942,321 | 6/1960 | Pinter et al. | 249/172 |
| 3,201,907 | 8/1965 | Henderson | 52/79.14 |
| 3,510,997 | 5/1970 | Ratych | 52/79.2 |
| 3,558,095 | 1/1971 | McNiel | 249/27 |
| 3,741,515 | 6/1973 | Rice | 249/26 |
| 4,033,545 | 7/1977 | Duwe et al. | 249/172 |
| 4,048,772 | 9/1977 | Gaul | 52/236.3 |
| 4,142,705 | 3/1979 | Miller | 249/27 |
| 4,159,602 | 7/1979 | Polack | 52/79.9 |
| 4,178,343 | 12/1979 | Rojo, Jr. | 264/333 |
| 4,180,233 | 12/1979 | Johnson | 249/27 |
| 4,214,413 | 7/1980 | Los Monteros | 52/236.1 |
| 4,606,878 | 8/1986 | Day et al. | 264/308 |
| 4,673,159 | 6/1987 | Schmidgall | 249/27 |

FOREIGN PATENT DOCUMENTS

| | | | |
|---|---|---|---|
| 26307 | 7/1920 | Denmark . | |
| 3505465 | 8/1986 | Fed. Rep. of Germany . | |
| 50745 | 10/1966 | German Democratic Rep. | 52/79.2 |
| 626189 | 9/1978 | U.S.S.R. | 52/79.14 |
| 1237434 | 6/1986 | U.S.S.R. . | |
| 1274929 | 12/1986 | U.S.S.R. . | |

*Primary Examiner*—Jay H. Woo
*Assistant Examiner*—James P. Mackey
*Attorney, Agent, or Firm*—Warren L. Franz

[57] ABSTRACT

A U-shaped, half-room precast concrete building unit is molded in an open box-like framework having four L-shaped corner assemblies, facing pairs of horizontal legs of which are respectively joined by laterally-extending telescoping spacers, and facing pairs of vertical legs of which are respectively each joined by two laterally-spaced longitudinally-extending plates. Inserts having alternating voids and blocks are placed longitudinally between the vertical leg pairs to form complementary block and void patterns on the molded unit juncture edges. Retainers having projections are placed over the top edges of the plates to form complementary tongue and groove portions. Relative dimensions of the molded unit are selectable through adjustment of the relative positionings of the corner assemblies.

16 Claims, 2 Drawing Sheets

APPARATUS FOR MANUFACTURE OF PRECAST CONCRETE BUILDING UNITS

This is a continuation-in-part of copending U.S. patent application Ser. No. 07/558,858, entitled "Precast Concrete Building Units and Method of Manufacture Thereof," filed Jul. 27, 1990, now U.S. Pat. No. 5,081,805; which is a divisional of U.S. patent application Ser. No. 07/398,095, having the same title, filed Aug. 23, 1989, now abandoned. The disclosures of those applications are incorporated herein by reference.

BACKGROUND OF THE INVENTION

This invention relates generally to improved concrete building units and further to a method and apparatus for precasting the same.

Precast concrete building units of various types are known for use in building construction. A principal advantage of such elements is a reduction in labor costs and time incurred in erecting a building structure. It is known to precast entire room units, entire wall units and various other building elements, in a wide variety of sizes and configurations. Each of these units has its own benefits and advantages, as well as its own disadvantages and drawbacks. Many require heavy capital outlay for costly manufacturing plant facilities, costs to bring the precast units from point of manufacture to the building site, additional reinforcing for extensive transportation and handling, and special on-site erecting equipment.

It is known, for example, in hotel/motel building construction to assemble an entire building in modular form piecing together complete room units having prefabricated integral walls, ceiling and floor. Such units are large and heavy, which requires costly forming and causes difficulties in manufacture, transportation and erection. The room size is fixed in accordance with the precast unit, so variation in room size requires variation in the size of the molded unit. The height of the unit necessitates the use of scaffolding or similar structure in casting the ceiling and special accommodation must be made in the forms to achieve the box-like, hollow structure. Also, when such units are placed side by side to create the building structure, the wall thickness between adjacent rooms is unnecessarily doubled.

The unitary box-like structures such as those described suffer from a lack of flexibility and versatility and are limited in the uses to which they may be put. In a hotel/motel or condominium construction, for example, utilizing precast complete room units, an entire building will require additional on-site pouring or precast units of other types in order to complete assembly, the modular room units being suitable only for use as the rooms.

U.S. Pat. No. 4,606,878 to Day et al., for example, shows a method and apparatus for constructing complete precast concrete modular building units which include a base slab, a roof, two sidewalls and one end wall formed in a single molding operation. The outer surfaces are fabricated using a collapsible outer form having sidewall and end wall plates pivotally connected to a rectangular base plate. The interior surfaces are formed using a retractable inner form having hydraulically positionable elements. The mold form is very costly and the resulting structure is large and heavy, and limited in the uses to which it can be put. Also, the internal mechanism requires a certain minimum degree of skill to ensure proper operation.

U.S. Pat. No. 4,178,343 to Rojo, Jr. discloses a method and apparatus for precasting building components in the form of vertical wall units by means of reusable separable mold forms that are wheelable and can be utilized on-site. The units of Rojo, Jr. are smaller and more versatile than the larger, complete units of Day et al. but, nevertheless, require considerable on-site labor and erection skill and the use of a multiplicity of other components during building assembly. And, because of their small size, the number of units needed is very high.

Copending U.S. patent application Ser. No. 07/558,858 describes an improved precast concrete building unit in the form of a partial room configuration, which is suitable for use in room construction, but which also offers great versatility and flexibility for use as other components in modular building construction. That unit, shown in FIG. 1, takes the form of a half-room having a U-shaped configuration with a generally planar, horizontally extending web, from opposite longitudinal edges of which project a pair of spaced, generally planar, vertically extending flanges or leg sections. The extremities of the flanges or legs are respectively provided with complementary male and female members which serve as interlocking shear keys when two identical such units are placed in leg-to-leg, inverted relationship to complete top and bottom halves of a room. The outside edges of each unit at the junctures of the web and flanges are formed with complementary alternating tabs and voids to provide means for interlocking the outside juncture edges of identical units placed in diagonally adjacent, web-to-web inverted relationship.

One method for simple on-site fabrication of such improved building unit is described in the '858 application. That method employs reusable molding apparatus in the form of a wheeled cart of uniform inverted U-shaped cross-section and having a pair of laterally-spaced, vertical outer sidewall plates hingedly attached at lower edges to outside edges of outwardly extending flanges of a mold bottom comprising a pair of laterally-spaced, lesser height, vertical inner sidewall plates joined at upper edges by a horizontal top plate. Though some provision is made for being able to vary the size of the molding apparatus, in general the apparatus is sized to match the dimensions of the desired building unit, and its flexibility for being reusable to produce similar units of differing dimensions is limited.

SUMMARY OF THE INVENTION

It is an object of the present invention to provide a method and apparatus for the manufacture of improved precast concrete building units of the type described in Applicant's copending U.S. patent application Ser. No. 07/558,858, employing simple steps that can be accomplished on-site at ground level, with a high degree of repeatability using unskilled labor, and with simple, manageable, inexpensive forms, yet having great flexibility for reusability to produce similar units of differing dimensions.

In one aspect of the invention, apparatus for forming improved precast building units of the type disclosed in the '858 application comprises an open box-like framework having four L-shaped corner assemblies, pairs of horizontal legs of which are respectively joined by laterally-extending telescoping spacers and pairs of vertical legs of which are respectively joined by longitudinally-extending plates.

In a preferred embodiment, described in greater detail below, the corner assemblies comprise rectangular cross-sectioned, hollow tubular members placed in spaced apart relationship and joined laterally by telescopingly, internally received, rectangular cross-sectioned spacers and longitudinally by externally abutting pairs of laterally-spaced planar members, such as plywood boards. Retainers and inserts are placed longitudinally along the top and bottom of mold cavities formed between the boards to give the impressions needed for tongue and groove, and block and void patterns.

The precast concrete building units formed in accordance with the method and apparatus of the invention provide significant benefits over conventional precast structures. With the molding apparatus of the invention, all concrete pouring can be done close to ground level (less than 5 feet high), thereby increasing safety because workers do not have to work on elevated platforms. All unit fabrication can be done at the site of building construction with attendant savings in transportation and storage costs. The simple construction of the molding apparatus permits ready use thereof by unskilled labor with a minimum amount of training, while achieving a high repeatability in fabrication of identical units. The molding unit provides great flexibility and versatility, allowing it to be reused to give many different sized building units to provide different sized rooms in accordance with individual preferences.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DETAILED DESCRIPTION OF PREFERRED EMBODIMENTS

Figure 1:
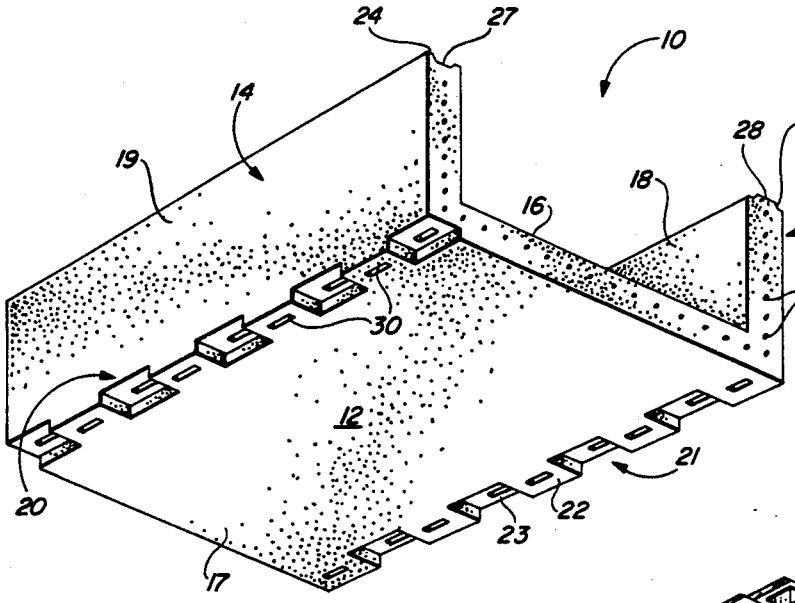
FIG. 1 is a perspective view of a precast concrete building unit of the type described in Applicant's copending U.S. patent application Ser. No. 07/558,858.

The method and apparatus of the invention are described with reference to an exemplary implementation of molding apparatus for precasting an improved concrete building unit 10, of the type described in Applicant's copending patent application Ser. No. 07/558,858, and as shown in FIG. 1.

The unit 10 comprises a generally planar, horizontal web section 12 from opposite longitudinal edges of which extend a pair of spaced, generally planar, vertical leg sections or flanges 14, 15. The upper 16 and lower 17 surfaces of web 12, as well as the inner (facing) 18 and outer (non-facing) 19 surfaces of the leg sections 14, 15, are generally flat. The lines of juncture 20, 21 between the lower surface 17 of web 12 and the outer surfaces 19 of legs 14, 15 are characterized by alternating tabs 22 and voids 23. The pattern of tabs 22 and voids 23 of one juncture line 20 is dimensioned, configured and adapted to complement and fit into the pattern of voids 22 and tabs 21 of the opposite juncture line 21 of an identical, inverted second block 10 brought into diagonally adjacent web-to-web relationship with the first block 10.

The tops or upper end extremities 24, 25 of the respective legs 14, 15 are generally planar rectangular horizontal surfaces, except for a groove 27 that extends centrally and longitudinally for the full length of the top 24 and a tongue 28 that extends centrally and longitudinally for the full length of the top 25. The groove 27 and tongue 28 are formed as complementary mating female and male members whose purpose is to act as two-way shear keys to assist in interlocking a pair of identical units 10, brought into adjacent leg-to-leg relationship.

The dimensioning of the units 10 is selected to provide the desired material strength and configuration needed for the building construction intended. The leg or flange sections 14, 15 are generally made identical, except for variation necessitated by the accommodation of the groove 27 and tongue 28. For a typical unit 10 shown in FIG. 1, the vertical dimension of the voids 23 is suitably chosen to be about one-half the vertical dimension or thickness of the web section 12, and the lateral horizontal dimension (laterally of the web 12) of the voids 23 is chosen to be approximately one-half the corresponding lateral horizontal dimension or thickness of the legs 14, 15. A typical steel reinforced unit 10 may have a longitudinal dimension (front to back) of approximately 6 meters; a lateral dimension (side 19 to side 19) of approximately 3.7 meters; a height dimension (bottom 17 to top 24) of approximately 1.4 meters; and a leg thickness (side 19 to side 18) of approximately 0.2 meters.

Latticework in the form of intermeshed steel reinforcing rods or bars 29 (see FIG. 1) is preferably integrated within the structure of the unit 10 to provide a reinforced composite concrete unit. Hollow channels or cores 30 can be optionally formed vertically through the legs 14, 15, if desired, to serve as conduits through which additional reinforcing bars may be run for purposes of connecting through a plurality of interconnected units 10 during assembly of a building structure.

Figure 2:
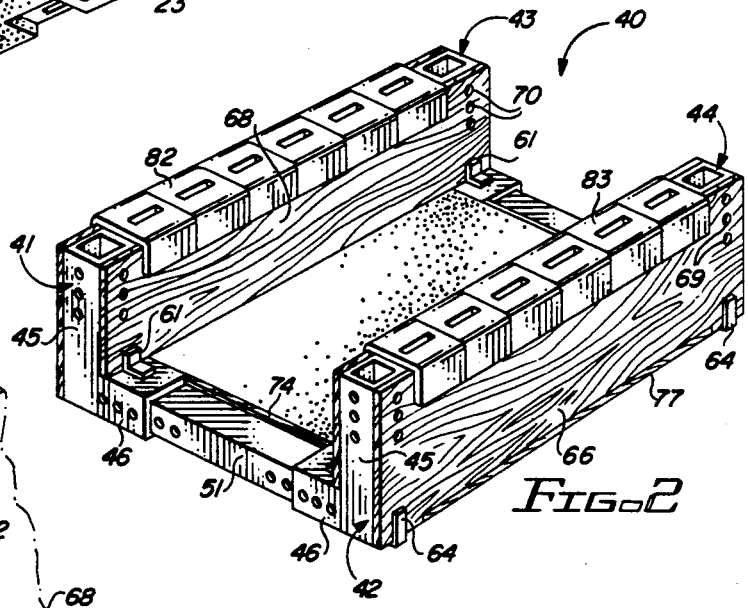
FIG. 2 is a perspective view of molding apparatus in accordance with the invention for manufacture of the building unit of FIG. 1.
Figure 3:
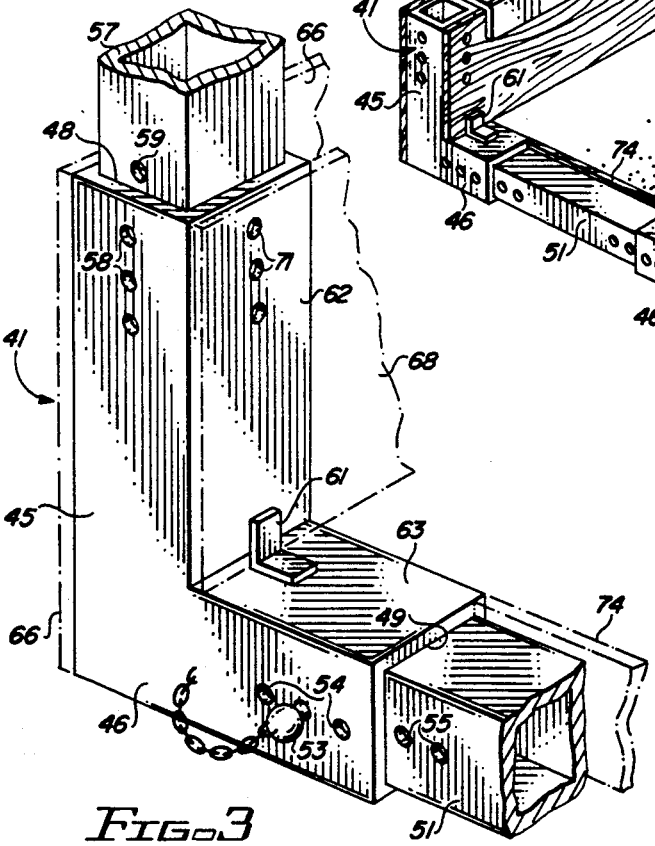
FIG. 3 is a fragmentary enlarged view of one of the corner assemblies of the apparatus of FIG. 2.

Molding apparatus 40 suitable for molding the building unit 10 is shown in FIG. 2. The mold 40 comprises four, L-shaped corner assemblies 41, 42, 43, 44, each including a vertical leg 45 extending upwardly in elbow fashion from one end of a laterally-extending, horizontal leg 46 (FIG. 3). The width (left to right extent in FIG. 3) of the leg 45 is dimensioned to correspond to the width (left to right extent in FIG. 1) of the leg 14 or 15 of the building unit 10. The height (top to bottom extent in FIG. 3) of the leg 46 corresponds to the height (top to bottom extent in FIG. 1) of the web 12. The assemblies 41, 42, 43, 44 are advantageously formed from intersecting rectangular cross-sectioned tubular members, as shown, respectively providing rectangular cross-sectioned vertical and horizontal internal channels 48, 49 interiorly of the legs 45, 46.

An elongated spacer member 51, having a rectangular cross-sectioned external configuration to match the internal configuration of the channel 49, is telescopingly received with opposite ends respectively received within channels 49 of facing legs 46 of longitudinally-spaced corner assembly pairs 41, 42 and 43, 44. The function of the spacers 51 is to fix the relative lateral positioning of the corner assemblies of each pair, thereby defining the lateral (left to right in FIG. 1) spacing of the legs 14, 15 of the unit 10 to be molded by the apparatus 40. A mechanism, such as a pin 53 (FIG. 3) that can be inserted within a selected one of a plurality of laterally-spaced apertures 54 in an external surface of leg 46 and into a correspondingly aligned selected one of a plurality of laterally-spaced apertures 55 in a corresponding surface of spacer 51, serves to releasibly lock the established position of the spacer 51 relative to each leg 46. To extend the width (left to right extent in FIG. 1) of web 12, the assemblies 41, 42 or 43, 44 are laterally further separated, spacer 51 is advanced out of one or both of the facing channels 49, and a different aperture 55 is aligned with the same aperture 54. To reduce the width of the web 12, the spacer 51 is retreated into one or both channels 49 and different apertures 54, 55 are aligned as with extension.

To provide a capability for extending the height of leg 45 beyond normally encountered limits, a vertical extension 57 can be similarly telescopingly fitted within the channel 48 of each leg 45, and a pin (not shown) can be used to lock the position of extension 59 by alignment of selected ones of apertures 58, 59. The height (bottom 17 to top 24) of the legs 14, 15 of unit 10 is controlled by the level to which concrete is poured in the mold cavities formed between the facing vertical legs 45 of pairs of corner assemblies 41, 43 and 42, 44, as described further below. Height adjustment through the vertical extensions 57 can increase the available height. A plate member (not shown) is added to match the surfaces of the legs 45 and extensions 57 used in the molding process.

Figure 6A:
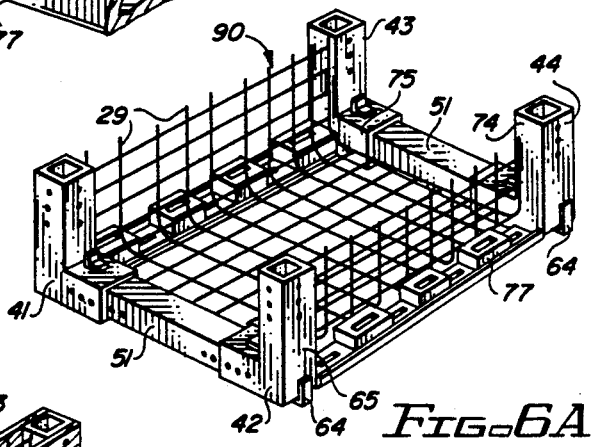
FIGS. 6A–6D are schematic views helpful in understanding the method of manufacturing the building unit of FIG. 1 using the molding apparatus of FIG. 2.

Each corner assembly 41, 42, 43, 44 includes an angled bracket 61 spaced away from a longitudinally-extending vertical planar side surface 62 (FIG. 3) of leg 45, and connected to the top of a laterally-extending horizontal top surface 63 of leg 46. Each assembly 41, 42, 43, 44 further includes another angled bracket 64 (FIG. 2) having a vertical portion spaced the same distance away from a longitudinally-extending vertical planar, opposite side surface 65 and a horizontal portion joined to the base of surface 65 (FIG. 6A). The spacer-connected assembly pairs 41, 42 and 43, 44 are aligned in laterally-spaced positions corresponding to the longitudinal dimension of the desired unit 10, and are joined by vertically planar external and internal plate members 66, 68 which are positioned in the spaces provided by the brackets 61, 64, in abutment with the surfaces 62, 65, respectively. Vertically-spaced apertures 69 and 70 (FIG. 2) are provided in plates 66, 68, respectively, for alignment with vertically-spaced apertures 71 (FIG. 3) in surfaces 62, 65 of leg 45. Releasible fasteners (not shown) are passed through the aligned apertures 69, 70, 71 to secure the plates 66, 68 onto the corners 41, 42, 43, 44. The plates 66, 68 can be conveniently provided by conventional plywood boards, whose longitudinal dimensions are selected to match the minimum desired longitudinal dimension of the unit 10, and which can be secured to the assemblies 41, 42, 43, 44 by threaded bolts or similar mechanisms.

The molding cavities 72, 73 (FIG. 6B) formed by laterally-extending, vertical planar, facing surfaces 74 (FIGS. 4 and 6B) of the legs 45, the facing inside surfaces of the plates 66, 68, and the underlying ground surface (which may be covered by a lubricated liner of other suitable mold base material) serve to mold the legs 14, 15 of the unit 10. Another plate member 74 (FIGS. 2 and 3) is placed adjacent the longitudinally-extending, vertical planar, inside surface of each spacer 51 to match and continue the inner flat surface contour of the aligned, longitudinally-extending, vertical planar, inside surfaces 75 (FIGS. 4 and 6A) of the legs 46 of the spacer-connected corner assemblies. The cavity 76 (FIG. 6B) formed by the facing inside surfaces of the legs 46 and plates 74, bottom portions of the facing inside surfaces of the plates 66 and the underlying ground surface serve to mold the web 12 of the unit 10.

Inserts 77, comprising interspersed blocks 78 and voids 79 formed on longitudinally-extending base plates 80, are fitted in complementary configurations along the bases of the mold cavities 72, 73 to define the corresponding tabs 22 and voids 23 of the juncture edges 20, 21 of the molded unit 10. A flange or rim 81 extends upwardly from an outside longitudinal border edge of the plate 80, spaced from the outside vertical surface of the block 78 by a distance slightly greater than the width of the plate 66. The flange 80 serves to position the inserts 77 relative to the plates 66. The inserts 77 may be provided by individual elements each having one block 78 and one void 79, as shown; or may be constituted as a single entity having multiple blocks 78 and voids 79. Turning the rim 80 around to match the plates 66 of opposite corner pairs 41, 43 and 42, 44 will automatically position a block 78 opposite a void 79, and vice versa.

Figure 5:
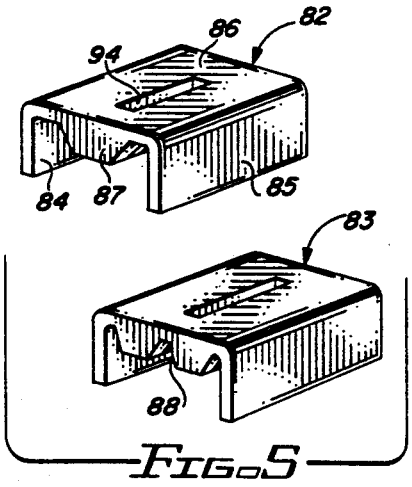
FIG. 5 is a fragmentary enlarged view of mold capping elements suitable for forming tongue and groove patterns on the building unit.

Retainers 82, 83 (FIG. 5) are placed over the adjacent top edges of laterally-spaced plates 66, 68 to prevent bulging apart of the plates during the molding process, and also to define the groove 27 and tongue 28 parts of the molded unit 10. Each retainer 82 is the length of a block 78 or void 79 of an insert 77, and comprises an inverted U-shaped element having parallel laterally-spaced, longitudinally-extending legs 84, 85 joined by a central horizontally laterally-extending portion 86. A groove forming downward projection 87 depends centrally longitudinally therefrom. Each retainer 83 is similarly configured, except that a tongue forming dual projection 88 depends centrally longitudinally from the horizontal portion 86 in place of the groove forming portion 87.

The method of manufacture of the unit 10 of FIG. 1, utilizing the molding apparatus 40 of FIGS. 2–5, is illustrated with reference to FIGS. 6A–6D.

Figure 6B:
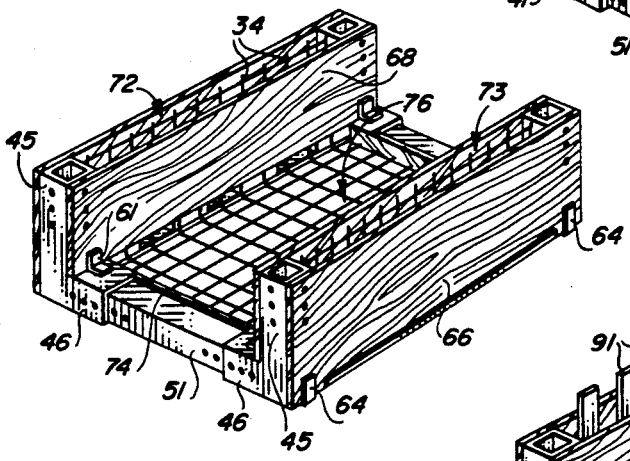
Figure 6C:
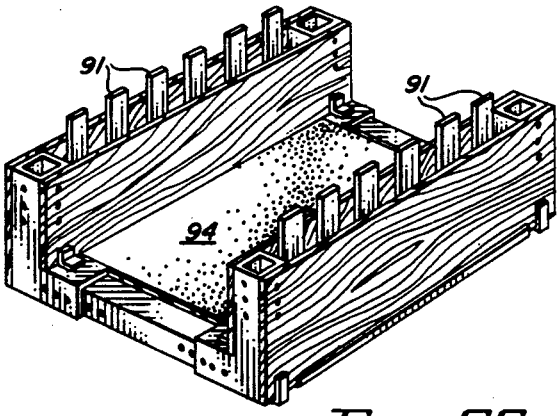
Figure 6D:
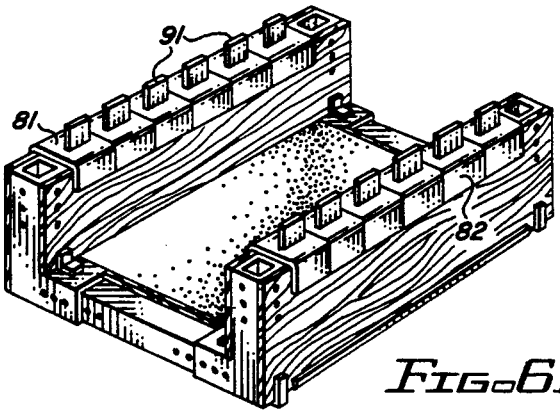

As shown in FIG. 6A, the connected corner assembly pairs 41, 42 and 43, 44 are fixed in their desired laterally-spaced positions by adjustment (advance or retraction) of the associated spacer 51 joining each connected pair. This sets the lateral dimension of the unit 10. The connected pairs are aligned and longitudinally-spaced to set the longitudinal dimension of the unit 10. The complementary block-and-void forming inserts 77 are then arranged between corresponding corner assemblies 41, 43 and 42, 44 of the joined pairs. A latticework 90 of steel reinforcing bars 79 is then positioned as desired in what will become the mold cavities 72, 73 and 76 (FIG. 6B).

Next, plates 66, 68, in the form of plywood boards, are brought into their vertical positions between brackets 61, 64 and the adjacent vertical surfaces of legs 45 of the longitudinally-aligned pairs 41, 43 and 42, 44. Other plates 74 are inserted to fill the discontinuities in surfaces 75 (FIG. 4) caused by differences in dimensioning between the spacers 51 and horizontal legs 46 of the connected pairs (FIG. 6B). The boards 66, 68 must be long enough to extend the longitudinal spacing of the pairs 41, 43 and 42, 44, but may go beyond that to permit longer units 10 to be made later with the same boards if desired. The lateral extensions of the boards 74 must match the lateral spacing of the pairs 41, 42 and 43, 44; however, each board 74 may be pieced together from shorter members, so that the lateral dimension can be varied by adding or deleting sections.

Figure 4:
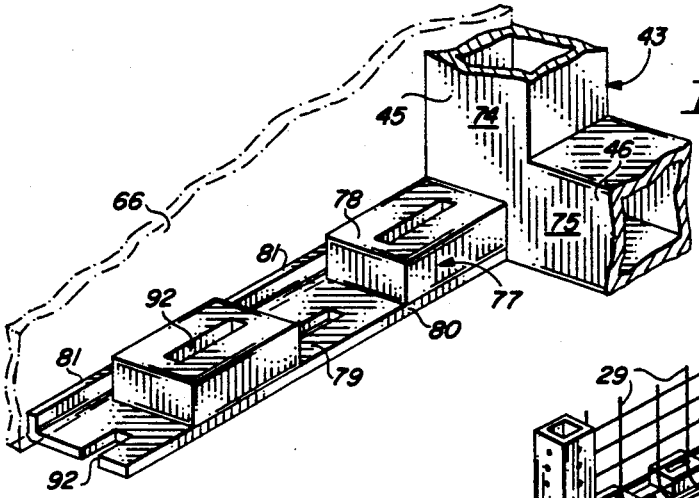
FIG. 4 is a fragmentary enlarged view of mold insert elements suitable for forming block and void patterns on the building unit.

Thereafter, studs 91 (FIG. 6C) may, optionally, be inserted vertically into the formed mold cavities 72, 73 by matching the bottom of the studs 91 into openings 92, formed in the inserts 77 to give the desired spacing (FIG. 4). A conventional formulation of mixed concrete 94 is next poured to the desired height into the mold cavities 72, 73, 74. Vibration or similar known means is applied to remove air bubbles from the concrete mix and the exposed top surfaces of the uncured unit 10 can be leveled, if desired, by means of conventional leveling or scraping devices drawn thereacross. The studs 92 or other channel creating elements (viz. styrofoam or cardboard tubing) make the hollow channels or cores 30 (FIG. 1) or other features, and conventional lifting rings or hooks (not shown) may be added prior to or during the concrete pouring step, for later use in hoisting the finished unit. The retainers 82, 83 are then added over the adjacent top edges of the boards 66, 68 (FIG. 6D) to keep the boards from bulging apart under the weight of the uncured concrete, and to provide the forms for creating the groove 27 and tongue 28 portions of the finished unit 10. The retainers 82, 83 are conveniently provided with openings 94 (FIG. 5) to match the openings 92 of inserts 77. The openings 94 are passed over tops of the studs 91 (FIG. 6D) to fix the positions of the studs 91.

When the concrete 94 has cured sufficiently, the mold 40 is opened by reversing the assembly process. The molded unit 10 is thereafter available for orienting and stacking as needed to construct a modular building or other structure, as described in the '858 application.

Those skilled in the art to which the invention relates will appreciate that other substitutions and modifications can be made to the described embodiment without departing from the spirit and scope of the invention as described by the claims below.

What is claimed is:

1. Apparatus for the molding of a precast concrete building unit comprising a horizontal web, and flanges respectively joined at opposite juncture edges to the web and extending vertically therefrom out toward extremities of the flanges; said apparatus comprising:

two longitudinally-spaced pairs of L-shaped corner assemblies; each assembly including a vertical leg having a base, and a laterally-extending horizontal leg having an end joined to said vertical leg at said base and having a free end facing the corresponding free end of another assembly of the same pair;

two laterally-extending spacers, each having opposite ends respectively telescopingly received within the facing free ends of the assemblies of each pair;

adjustable means releasably locking the position of said spacers relative to said free ends to establish the lateral spacing of said assemblies of each pair and, thereby, establishing a lateral dimension of the web of the building unit;

two pairs of laterally-spaced vertically-oriented plates, each pair of plates extending between corresponding vertical legs of associated longitudinally-spaced assemblies of each of said pairs of assemblies; the spacing between said plates in each of said pairs of plates establishing a lateral dimension of the flanges of the unit; each of said plates having a top edge;

means removably mounting said plates on said corner assemblies;

inserts, having alternating block and void forming members, positioned longitudinally between each of said corresponding vertical legs and between each of said pairs of plates, for forming complementary block and void patterns on the juncture edges of the unit; and retainers, removably located over the top edges of each of said pairs of plates and respectively including tongue forming means and groove forming means for forming corresponding tongue and groove portions on the extremities of the flanges of the unit.

2. Apparatus as in claim 1, wherein said corner assemblies comprise rectangular cross-sectioned, hollow tubular members; and said spacers comprise rectangular cross-sectioned elements telescopingly, internally received within said tubular members.

3. Apparatus as in claim 1, wherein said horizontal legs are formed with a first plurality of laterally-spaced apertures; said spacers are formed with a second plurality of laterally-spaced apertures; and said releasably locking means comprises pins removably inserted within corresponding aligned selected ones of said first and second pluralities of apertures.

4. Apparatus as in claim 1, wherein said vertical legs of said longitudinally-spaced assemblies have upper ends opposite said bases; and further comprising vertically-extending extensions respectively telescopingly received within said upper ends; and adjustable means releasably locking the positions of said extensions relative to said upper ends to establish the heights of said assemblies and, thereby, establishing height dimensions of the flanges of the unit.

5. Apparatus as in claim 1, wherein said means mounting said plates on said corner assemblies comprises angled brackets connected to said corner assemblies and including vertical portions spaced from said vertical legs.

6. Apparatus as in claim 1, wherein said spacers have facing inside surfaces on portions of said spacers not received within said free ends of said assemblies; and further comprising a pair of plate members respectively placed adjacent said facing inside surfaces of said spacers.

7. Apparatus as in claim 1, wherein said inserts comprise longitudinally-extending base plates; and blocks formed on said base plates interspersed by voids.

8. Apparatus as in claim 7, wherein each base plate has an outside longitudinal edge and a flange extending upwardly from said outside longitudinal edge; said flange being spaced from said blocks.

9. Apparatus as in claim 8, wherein each retainer comprises a plurality of retainer elements, each retainer element being of a length corresponding to the length of a block formed by said block and void forming members.

10. Apparatus as in claim 8, wherein each retainer comprises an inverted U-shaped element having parallel laterally-spaced, longitudinally-extending having joined by a central horizontal laterally-extending portion.

11. Apparatus as in claim 10, wherein one of said retainers has a groove forming downward projection depending centrally from its horizontal portion and another of said retainers has tongue forming dual projections depending centrally from its horizontal portion.

12. Apparatus for the molding of a precast concrete building unit comprising a horizontal web, and flanges respectively joined at opposite juncture edges to the web and extending vertically therefrom out toward extremities of the flanges; said apparatus comprising:

two longitudinally-spaced pairs of L-shaped corner assemblies; each assembly including a vertical leg having a base and an upper end, and a laterally-extending horizontal leg having an end joined to said vertical leg at said base and having a free end facing the corresponding free end of another assembly of the same pair; and each assembly comprising a rectangular cross-sectioned, hollow tubular member having an internal channel;

two laterally-extending spacers, each comprising an elongated rectangular cross-sectioned element having opposite ends respectively telescopingly received within the internal channels at said facing free ends of the assemblies of each pair;

adjustable first means releasably locking the position of said spacers relative to said free ends to establish the lateral spacing of said assemblies of each pair and, thereby, establishing a lateral dimension of the web of the building unit;

vertically-extending extensions respectively telescopingly received within the internal channels at said upper ends of the assemblies;

adjustable second means releasably locking the positions of said extensions relative to said upper ends to establish the heights of said assemblies and, thereby, establishing height dimensions of the flanges of the unit;

two pairs of laterally-spaced vertically-oriented plates, each pair of plates extending between corresponding vertical legs of associated longitudinally-spaced assemblies of each of said pairs of assemblies; the spacing between said plates in each of said pairs of plates establishing a lateral dimension of the flanges of the unit; each of said plates having a top edge;

means removably mounting said plates on said corner assemblies;

inserts, comprising longitudinally-extending base plates, and blocks formed on said base plates interspersed by voids, positioned longitudinally between each of said corresponding vertical legs and between each of said pairs of plates, for forming complementary block and void patterns on the juncture edges of the unit; and retainers, removably located over the top edges of each of said pairs of plates and respectively including tongue forming means and groove forming means for forming corresponding tongue and groove portions on the extremities of the flanges of the unit.

13. Apparatus as in claim 12, wherein said horizontal legs are formed with a first plurality of laterally-spaced apertures; said spacers are formed with a second plurality of laterally-spaced apertures; and said releasably locking first means comprises pins removably inserted within corresponding aligned selected ones of said first and second pluralities of apertures.

14. Apparatus as in claim 13, wherein said spacers have facing inside surfaces on portions of said spacers not received within said free ends of said assemblies; and further comprising a pair of plate members respectively placed adjacent said facing inside surfaces of said spacers.

15. Apparatus as in claim 14, wherein each base plate has an outside longitudinal edge and a flange extending upwardly from said outside longitudinal edge; said flange being spaced from said blocks.

16. Apparatus as in claim 15, wherein each retainer comprises an inverted U-shaped element having parallel laterally-spaced, longitudinally-extending legs joined by a central horizontal laterally-extending portion; one of said retainers has a groove forming downward projection depending centrally from its horizontal portion; and another of said retainers has tongue forming dual projections depending centrally from its horizontal portion.

* * * * *